US006168473B1

(12) United States Patent
Hsin

(10) Patent No.: US 6,168,473 B1
(45) Date of Patent: Jan. 2, 2001

(54) CLAMPING STRUCTURE FOR COMMUNICATION CONNECTOR

(76) Inventor: Liao Sheng Hsin, No. 137, San Chun St. Shu Lin Jen, Taipei Hsien (TW)

( * ) Notice: Under 35 U.S.C. 154(b), the term of this patent shall be extended for 0 days.

(21) Appl. No.: 09/241,907

(22) Filed: Feb. 2, 1999

(51) Int. Cl.[7] ..... H01R 24/00; H01R 13/625
(52) U.S. Cl. ..... 439/676; 439/345
(58) Field of Search ..... 439/676, 638, 439/681, 536, 352, 344, 345, 385; 43/701

(56) References Cited

U.S. PATENT DOCUMENTS 4,266,845 * 5/1981 Ishikawa ..... 339/258 R
4,274,691 * 6/1981 Abernethy et al. ..... 339/19
5,957,730 * 9/1999 Wang ..... 439/676
5,971,800 * 10/1999 Azuma et al. ..... 439/502

* cited by examiner

*Primary Examiner*—Brian Sircus
*Assistant Examiner*—Chandrika Prasad
(74) *Attorney, Agent, or Firm*—Rosenberg, Klein & Lee

(57) ABSTRACT

A clamping structure for communication connector, wherein the connector has an insulating case, at least one coupling hole on the insulating case, a plurality of terminals with each the coupling hole, the end portion of the terminal exposing out of the insulating case. The clamping structure is characterized in that a plurality of clamping devices are arranged within the coupling hole and on the two bottom lateral sides of the coupling, the clamping means being supported within the coupling hole by elastic member. The inventive communication connector has clamping means with flexibility to firmly clamp the mating connector of various specifications. Therefore, the insulating case has broader applicability, thus reduces cost.

3 Claims, 8 Drawing Sheets

PIROR ART

CLAMPING STRUCTURE FOR COMMUNICATION CONNECTOR

FIELD OF THE INVENTION

The present invention relates to a clamping structure for communication connector, more particularly, to a clamping structure which enables the insulating case of the connector to have high applicability.

BACKGROUND OF THE INVENTION

As shown in FIG. 1, the conventional communication connector has an insulating case 10*a* and at least one coupling hole 11*a* connected with the mating connector. A plurality of conductive terminals 12*a* (for examples, 4, 6, 8, or 10 terminals) are provided within the coupling holes 11*a* to connect to the corresponding terminals of the mating connector. The terminal 12 has one end portion 13*a* exposing out of the insulating case 10*a* and inserting into the circuit board.

In above-mentioned communication connector, the terminals generally have predetermined specification, such as 4 pins, 6 pins, 8 pins, or 10 pins. Therefore, the insulating case is demanded to have corresponding size and shape to match the various specification of the terminals and connect with the mating connector. The applicability of the insulating case is limited.

Even thought the terminals of different specification can be housed with the same insulating cases of the same specification and then coupled to each other. However, problems arise when the coupling hole of the insulating case is coupled to a mating connector with smaller pin number, wherein gap is formed between the coupling hole 11*a* and the mating connector to influence the clamping effect. Therefore, the insulating case still has limited applicability in this way.

It is the object of the present invention to provide a clamping structure for communication connector, wherein the coupling hole thereof can be adapted to accommodate mating connector, even though the mating connector has fewer pin number. The inventive communication connector has clamping means with flexibility to firmly clamp the mating connector of various specification. Therefore, the insulating case has broader applicability, thus reduces cost. The various objects and advantages of the present invention will be more readily understood from the following detailed description when read in conjunction with the appended drawing, in which:

DETAIL DESCRIPTION OF PREFERRED EMBODIMENT

Figure 1:
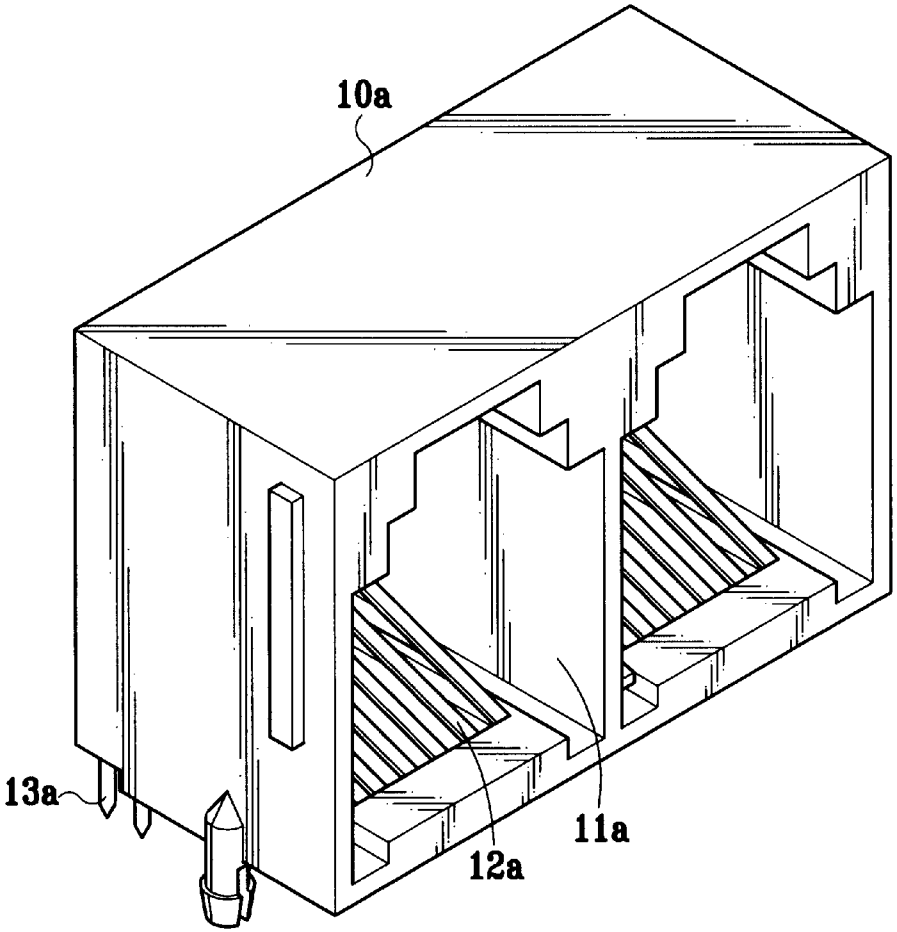
FIG. 1 is the perspective view of a conventional communication connector.
Figure 2:
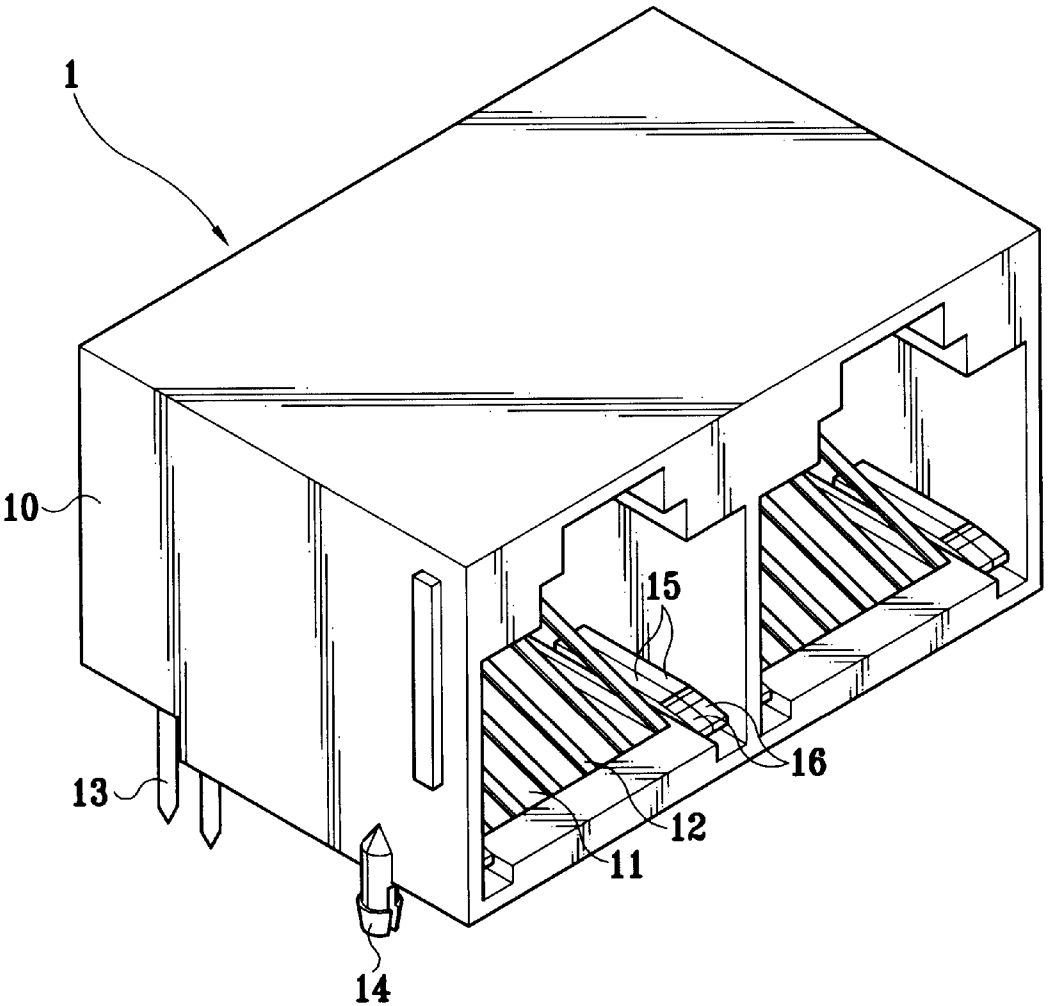
FIG. 2 is the perspective view of the present invention.
Figure 3:
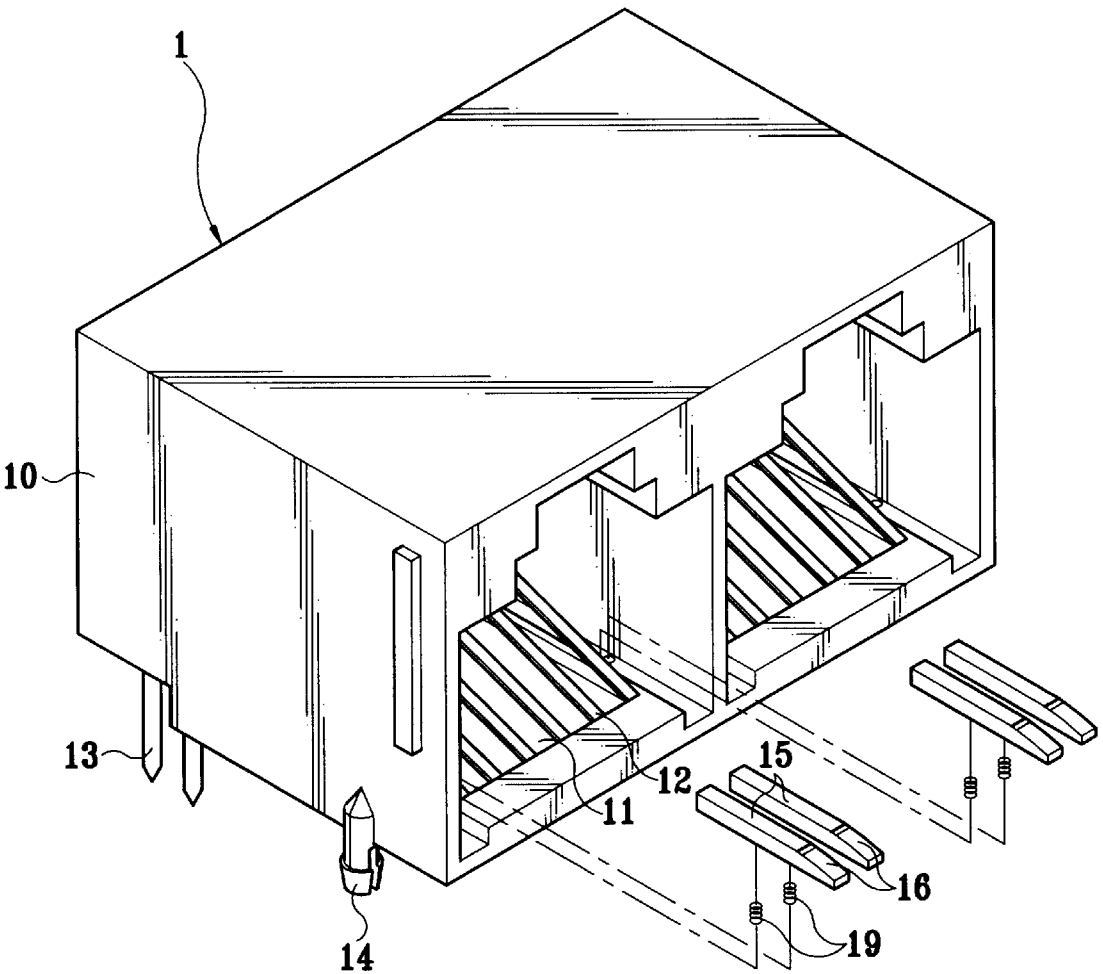
FIG. 3 is the exploded view of the present invention.

As shown in FIGS. 2 and 3, the inventive communication connector is intended to provide a communication connector 1 which comprises an insulating case 10 and at least one coupling hole 11 to connect to the mating connector. In the preferred embodiment, there are two coupling holes 11. A plurality of terminals 12 made of conductive material (in the preferred embodiment, 6 terminals) are provided within the coupling hole 11. The end portion 13 of the terminal 12 exposes out of the insulating case 10 for connecting to the circuit board. The insulating case 10 has locking members 14 provided on two bottom lateral sides thereof. However, the above-mentioned components are not features of the present invention, the detailed description thereof is omitted for clarity.

Figure 4:
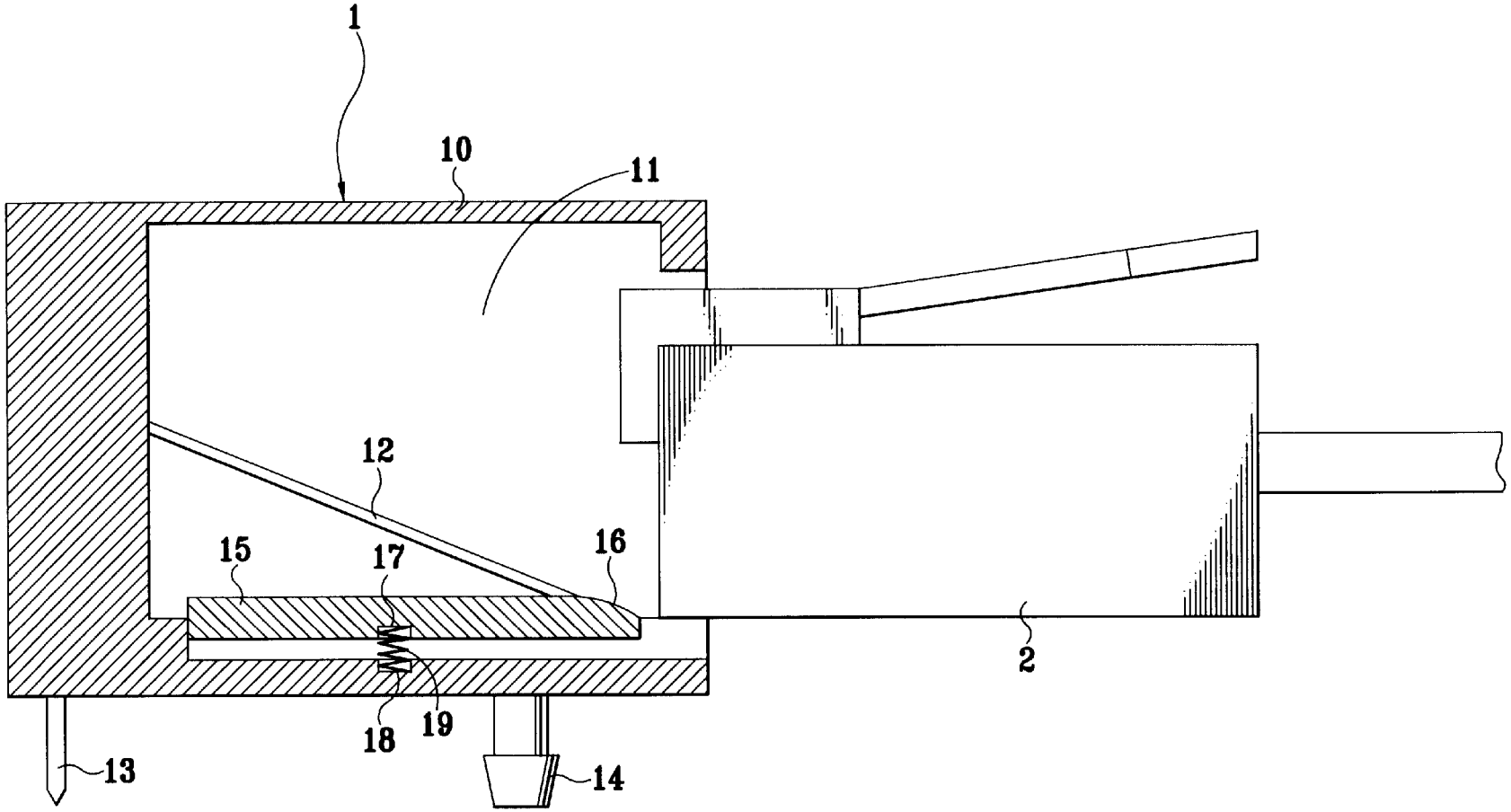
FIG. 4 shows the state of the inventive connector when not being connected with mating connector.
Figure 5:
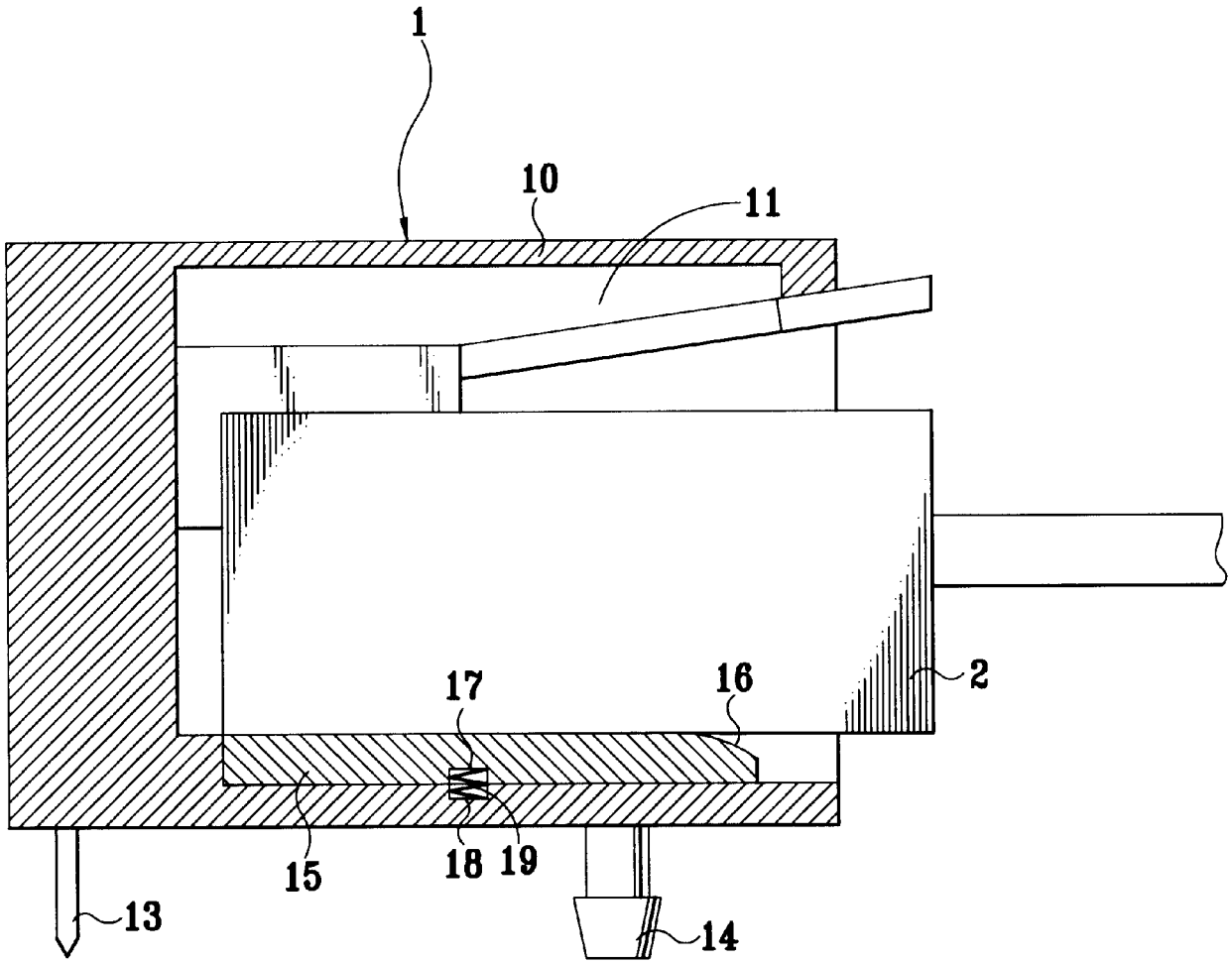
FIG. 5 shows the state of the inventive connector after being connected with mating connector.

The present invention is characterized in that a plurality of clamping means 15 are provided on the inner bottom side of the coupling hole 11 and near the both lateral sides of the coupling hole 11. The clamping means 15 of long strip shape and has a tilt guiding surface 16 on the front top side thereof. The clamping means 15 has at least one first fixing hole 17 on the bottom side thereof, as shown in FIGS. 4 and 5, and a corresponding second fixing hole 18 is arranged on the inner bottom side of the coupling hole 11. An elastic member 19 is provided between the first fixing hole 17 of the clamping means 15 and the second fixing hole 18 of the coupling hole 18. The upper end and lower end of the elastic member 19 are retained within the first fixing hole 17 and the second fixing hole 18 such that the clamping means 15 can be clamped within the coupling hole 11 by virtue of the elasticity of the elastic member 19, thus provides a clamping structure.

In the present invention, the insulating case 10 of the connector 1 is designed to house terminals with relatively large number such as 10 pins, thus provides broader applicability. The insulating case 10 can be adapted to house terminals 12 with pin numbers 4, 6, 8, or 10 such that the connector 1 can be conveniently connected to a mating connector with corresponding pin number, i.e., 4, 6, 8, or 10 pins.

Figure 7:
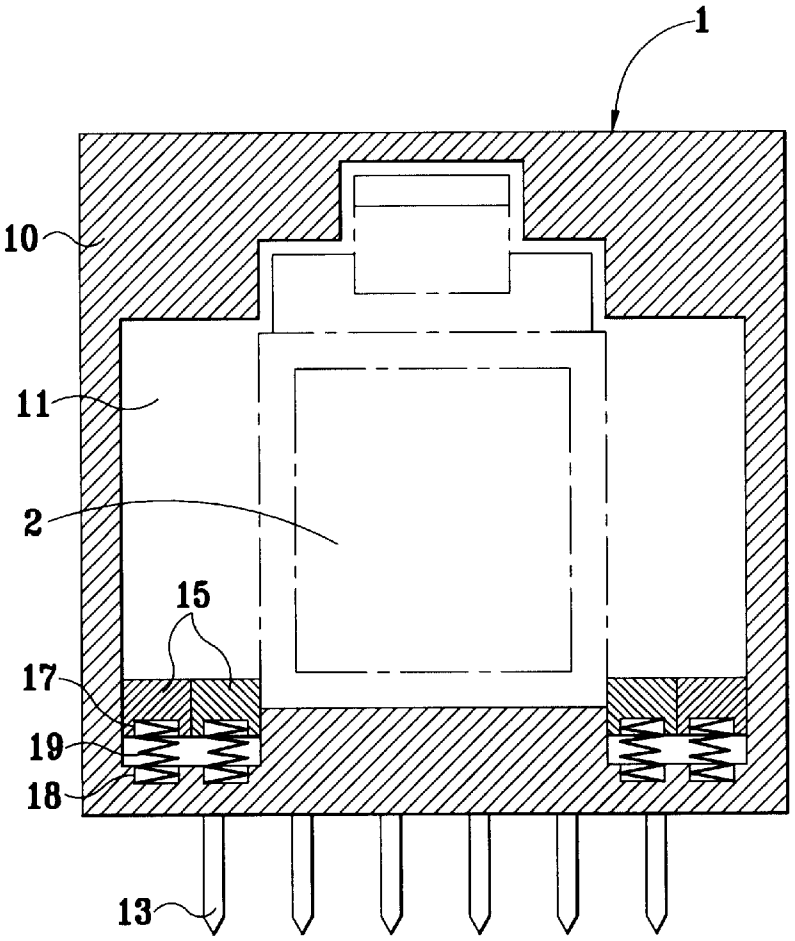
FIG. 7 shows the inventive connector connected to a mating connector of different specification.
Figure 6:
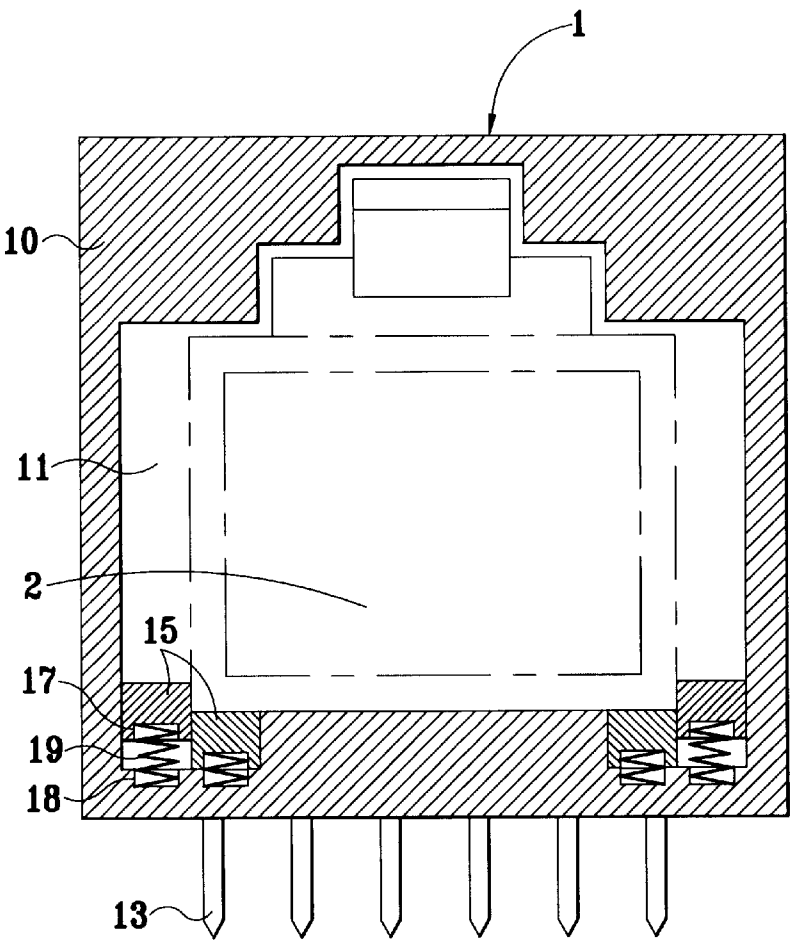
FIG. 6 is a plan view showing the inventive connector clamped to the mating connector.
Figure 8:
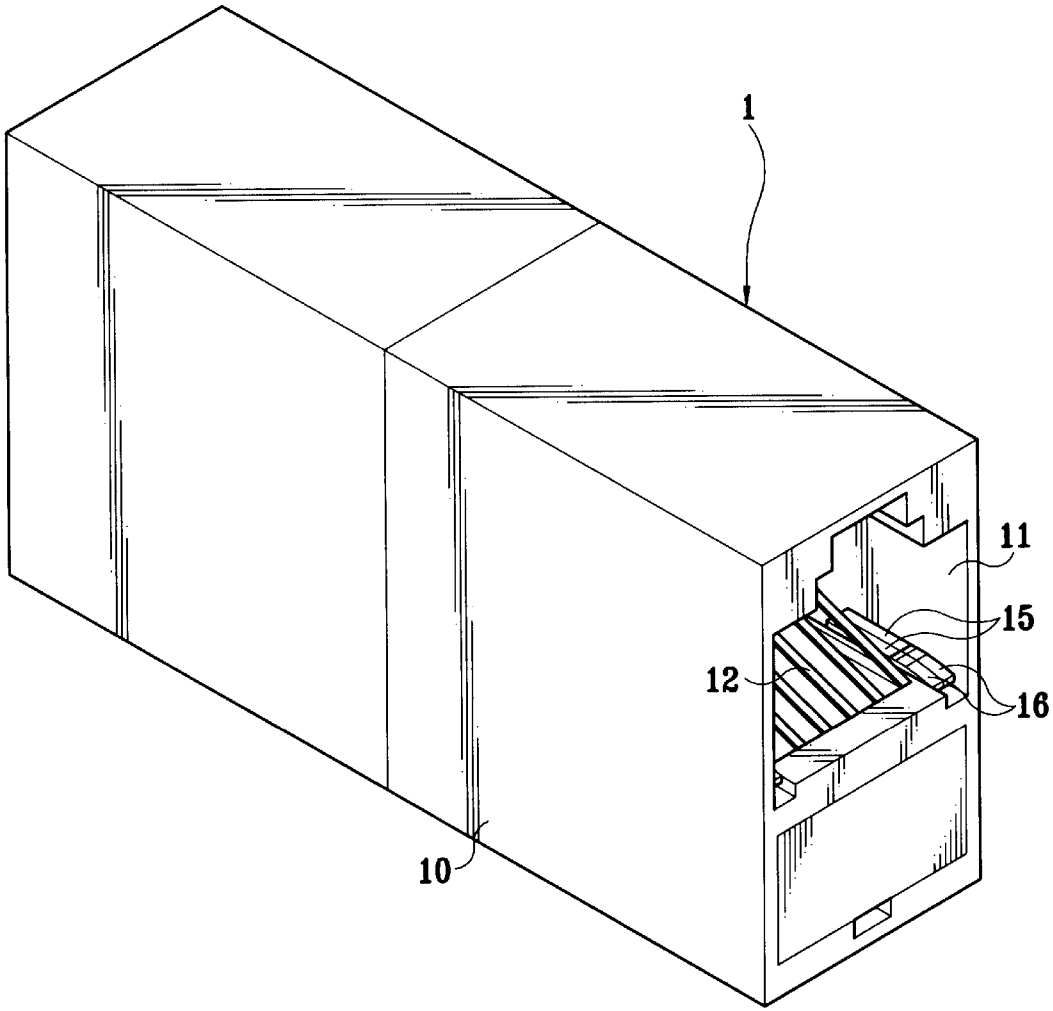
FIG. 8 shows the perspective view of another embodiment of the invention.
Figure 9:
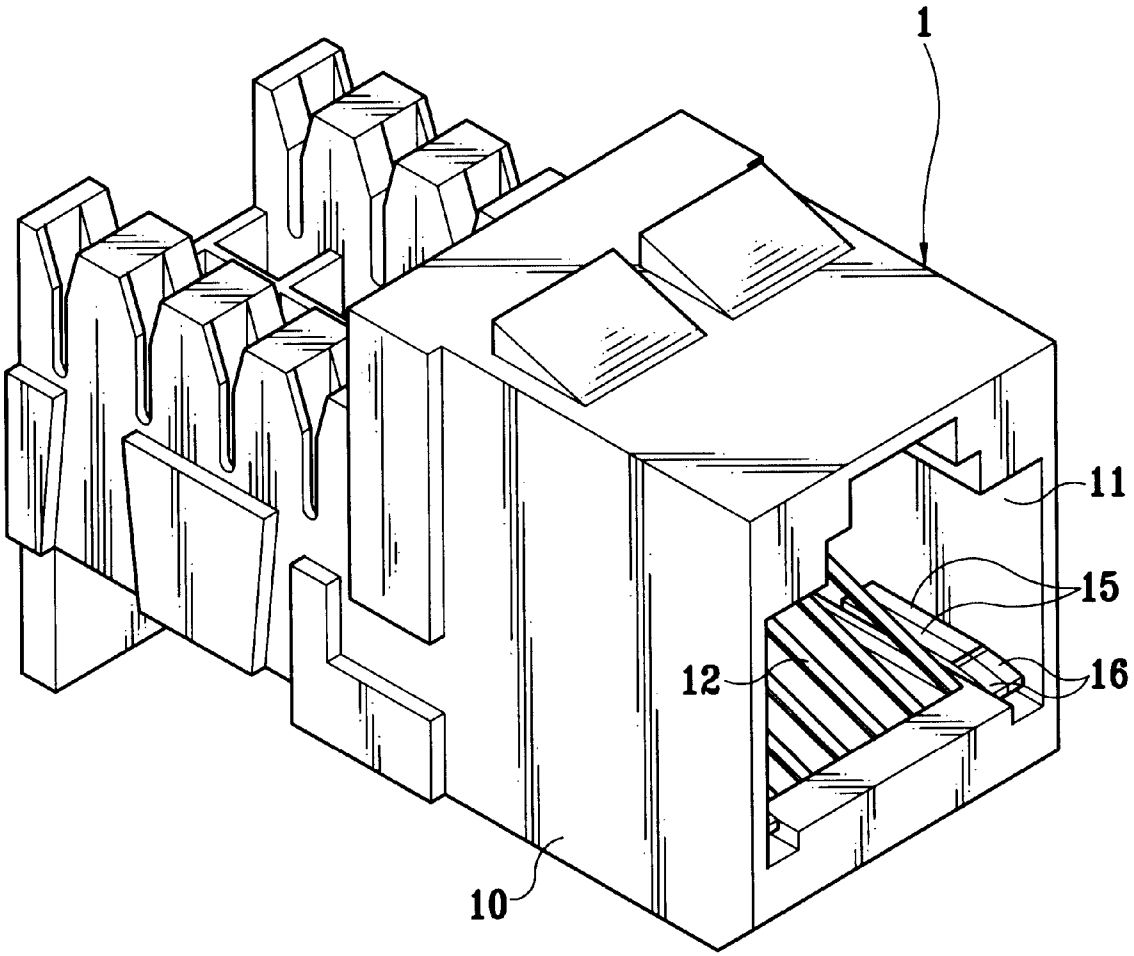
FIG. 9 shows the perspective view of another embodiment of the invention.

When the insulating case 10 is applied to a connector of less pin number, such as 4 pins or 6 pins, the insulating case 10 requires connecting to a mating connector 2 with less pin number. A problem is risen that gap is formed between the coupling hole 11 and the mating connector 2. As shown in FIGS. 4, 5, and 6, the mating connector 2 pushes away the guiding surface 16 and then is clamped between the top surfaces of the two clamping means 15. Therefore, the mating connector 2 can be firmly clamped within the insulating case 10 by the clamping force provided by the two clamping means 15. Moreover, the portion of the mating connector 2 on two bottom lateral sides are also clamped by another two clamping means 15 on outer position. In other words, the mating connector 2 can be firmly fixed by the arrangement of the clamping means 15. Moreover, as shown in FIG. 7, when a mating connector 2 with further fewer pin number is inserted into the insulating case 10, the bottom lateral sides of the mating connector 2 are supported by two inner clamping means 15. In this way, the mating connector with further less pin number can also be clamped within the insulating case 10. More specifically, the inventive connector 1 is applicable to mating connectors of various size by the novel design of the coupling hole 11. Even thought the connector is used to connect with a mating connector with fewer pins, the mating connector can be firmly clamped by the clamping means. Therefore, the insulating case 10 has broader applicability and the cost of molding for insulating case is reduced. Moreover, the present invention is applicable to other types of communication connector, as shown in FIGS. 8 and 9.

To sum up, the inventive communication connector has clamping means with flexibility to firmly clamp the mating connector of various specification. Therefore, the insulating case has broader applicability, thus reduces cost.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A clamping structure for a communication connector, said connector having (a) an insulating case, (b) at least one coupling hole formed in said insulating case, and (c) a plurality of terminals within said at least one coupling hole, each of said terminals having an end portion extending from said insulating case for external electrical connection, said clamping structure being characterized in that a plurality of clamping members are arranged within said at least one coupling hole for stabilizing mating connectors having a width less than a width of said at least one coupling hole, a portion of said plurality of clamping members being disposed on each of two bottom lateral sides of said at least one coupling hole between a respective endmost terminal and an adjacent inner side wall of said at least one coupling hole, each said clamping member being supported within said coupling hole by an elastic member.

2. The clamping structure as in claim 1, wherein each said clamping member has an angled surface portion on a front end thereof adjacent an open end of said at least one coupling hole.

3. A clamping structure for a communication connector, said connector having (a) an insulating case, (b) at least one coupling hole formed in said insulating case, and (c) a plurality of terminals within said at least one coupling hole, said clamping structure being characterized in that a plurality of clamping members are arranged within said at least one coupling hole for stabilizing mating connectors having a width less than a width of said at least one coupling hole, a portion of said plurality of clamping members being disposed on each of two bottom lateral sides of said at least one coupling hole between a respective endmost terminal and an adjacent inner side wall of said at least one coupling hole, each said clamping member being supported within said coupling hole by an elastic member, each said clamping member having a first fixing hole formed in a bottom side thereof, said at least one coupling hole having an inner bottom wall with a corresponding second fixing hole formed therein, said elastic member being provided between said first and second fixing hole, an upper end and a lower end of said elastic member being respectively placed within said first and second fixing holes.

* * * * *